US008258979B2

(12) United States Patent
Lemmons et al.

(10) Patent No.: US 8,258,979 B2
(45) Date of Patent: Sep. 4, 2012

(54) EMERGENCY VEHICLE ALARM SYSTEM AND METHOD

(76) Inventors: Albert G. Lemmons, Franklin, TN (US); Steven B. Riley, Franklin, TN (US)

( * ) Notice: Subject to any disclaimer, the term of this patent is extended or adjusted under 35 U.S.C. 154(b) by 0 days.

(21) Appl. No.: 13/043,140

(22) Filed: Mar. 8, 2011

(65) Prior Publication Data

US 2011/0221611 A1 Sep. 15, 2011

Related U.S. Application Data

(60) Provisional application No. 61/282,643, filed on Mar. 11, 2010.

(51) Int. Cl.
*G08G 1/00* (2006.01)
*G08G 1/16* (2006.01)

(52) U.S. Cl. ..... 340/901; 340/902; 340/903; 701/300; 705/13

(58) Field of Classification Search ..... None
See application file for complete search history.

(56) References Cited

U.S. PATENT DOCUMENTS

| | | | | |
|---|---|---|---|---|
| 3,873,963 | A | 3/1975 | Neal et al. | |
| 5,235,329 | A | 8/1993 | Jackson | |
| 5,278,553 | A | 1/1994 | Cornett et al. | |
| 5,307,060 | A * | 4/1994 | Prevulsky et al. | 340/902 |
| 6,160,493 | A | 12/2000 | Smith | |
| 6,166,656 | A | 12/2000 | Okada et al. | |
| 6,252,519 | B1 * | 6/2001 | McKenna | 340/902 |
| 6,417,782 | B1 * | 7/2002 | Darnall | 340/902 |
| 6,917,306 | B2 | 7/2005 | Lilja | |
| 7,174,154 | B2 | 2/2007 | Ehlers | |
| 7,406,321 | B2 | 7/2008 | Beiermeister | |
| 7,508,320 | B2 | 3/2009 | Taylor | |
| 7,538,687 | B2 * | 5/2009 | McKenna | 340/902 |
| 2001/0038344 | A1 * | 11/2001 | Garcia | 340/902 |
| 2002/0102961 | A1 | 8/2002 | Gibbons et al. | |
| 2003/0169185 | A1 * | 9/2003 | Taylor | 340/945 |
| 2004/0036627 | A1 * | 2/2004 | Knoski et al. | 340/902 |
| 2004/0190693 | A1 * | 9/2004 | Beiermeister | 379/88.18 |
| 2006/0003762 | A1 * | 1/2006 | Sumcad et al. | 455/428 |
| 2006/0089100 | A1 * | 4/2006 | Patenaude et al. | 455/41.2 |
| 2007/0190968 | A1 * | 8/2007 | Dickinson et al. | 455/404.1 |
| 2007/0241932 | A1 * | 10/2007 | Otero et al. | 340/901 |
| 2007/0273551 | A1 | 11/2007 | Jacobs et al. | |
| 2009/0096635 | A1 * | 4/2009 | McKenna | 340/901 |
| 2009/0150007 | A1 * | 6/2009 | Taylor | 701/2 |
| 2009/0174572 | A1 * | 7/2009 | Smith | 340/902 |
| 2009/0228157 | A1 * | 9/2009 | Breed | 701/1 |
| 2009/0299857 | A1 * | 12/2009 | Brubaker | 705/14.66 |
| 2010/0228404 | A1 * | 9/2010 | Link et al. | 701/1 |

* cited by examiner

*Primary Examiner* — Julie Lieu
(74) *Attorney, Agent, or Firm* — Richard C. Litman

(57) ABSTRACT

The emergency vehicle alarm system and method allows a user to select an emergency vehicle alert as a telematics service in a mobile vehicle. Once the user selects the alert service, a telematics operations center determines a service fee, bills the user, and debits the user's account accordingly. The emergency vehicle alert telematics service warns a civilian vehicle of an approaching emergency vehicle. The system includes a transmitter located in the emergency vehicle that transmits a signal adapted for reception by a receiving module of a telematics system located in the civilian vehicle. When the emergency vehicle signal is received by the receiving module in the civilian vehicle, an audio and/or visual alert is generated to alert the occupants of the civilian vehicle that an emergency vehicle is nearby. The civilian vehicle's telematics system may also display relative positioning of the emergency vehicle and the civilian vehicle.

3 Claims, 1 Drawing Sheet

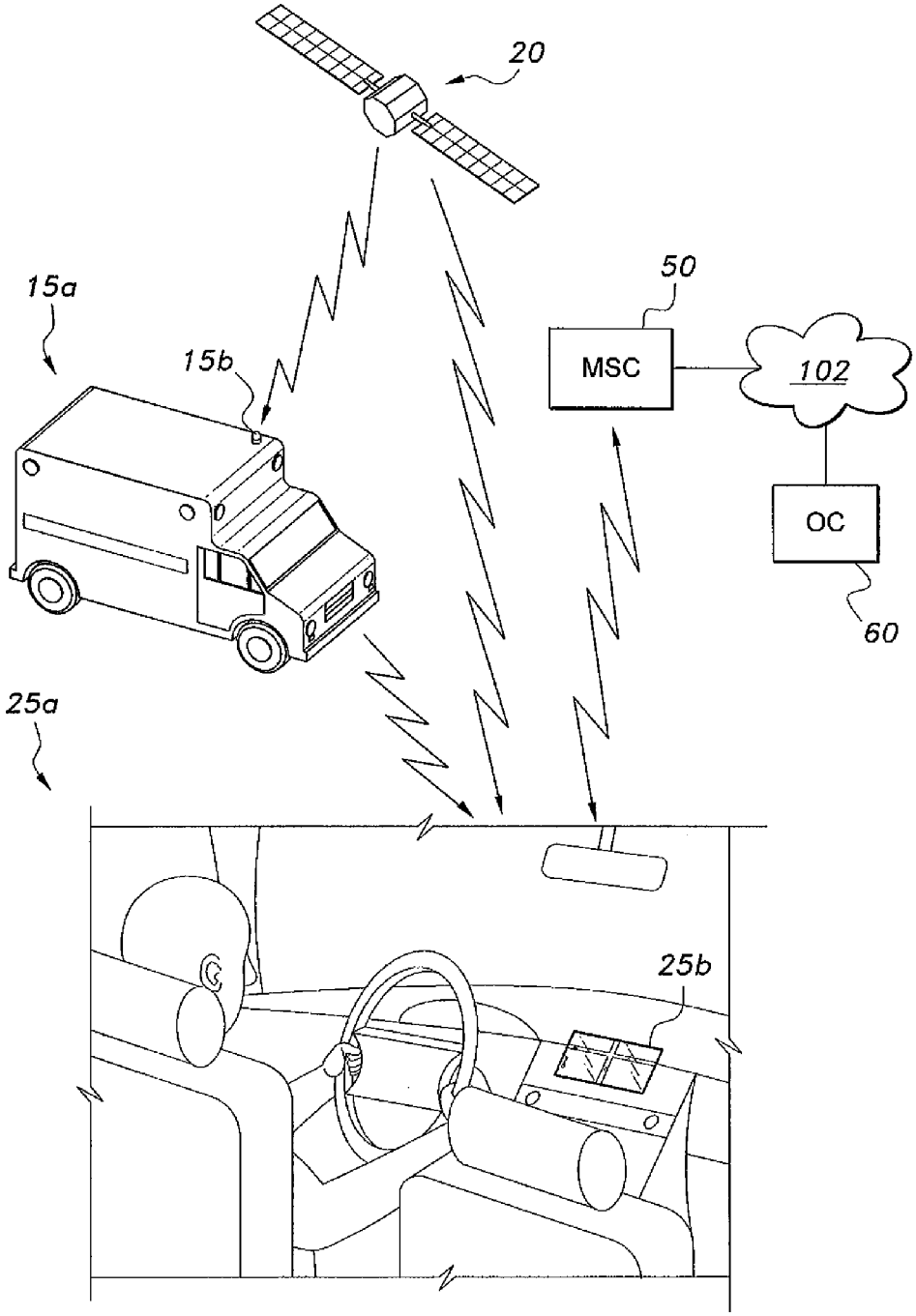
20
15a
15b
50
MSC
102
OC
60
25a
25b

EMERGENCY VEHICLE ALARM SYSTEM AND METHOD

CROSS-REFERENCE TO RELATED APPLICATION

This application claims the benefit of U.S. Provisional Patent Application Ser. No. 61/282,643, filed Mar. 11, 2010.

BACKGROUND OF THE INVENTION

1. Field of the Invention

The present invention relates to vehicle telematics, and more specifically, to an emergency vehicle alarm system and method that generates an audio and/or visual alarm to alert the occupants of the civilian vehicle that an emergency vehicle is nearby.

2. Description of the Related Art

Oftentimes drivers are distracted by radio noises, cell phone conversations and the like, and are not very responsive to approaching emergency vehicles, sirens, lights, horns, and all. It would be desirable to enhance emergency vehicle road traffic priority requests by adding an electronic warning feature in addition to emergency flashers sirens, horns, and the like.

Thus, an emergency vehicle alarm system and method solving the aforementioned problems is desired.

SUMMARY OF THE INVENTION

The emergency vehicle alarm system allows a user to select an emergency vehicle alert as a telematics service in a mobile vehicle. Once the user selects the alert service, a telematics operations center determines a service fee, bills the user, and debits the user's account accordingly. The emergency vehicle alert telematics service warns a civilian vehicle of an approaching emergency vehicle.

The system includes a transmitter located in the emergency vehicle that transmits a signal adapted for reception by a receiving module of a telematics system located in the civilian vehicle. When the emergency vehicle signal is received by the receiving module in the civilian vehicle, an audio and/or visual alert is generated to alert the occupants of the civilian vehicle that an emergency vehicle is nearby. The civilian vehicle's telematics system may also display relative positioning of the emergency vehicle and the civilian vehicle.

These and other features of the present invention will become readily apparent upon further review of the following specification and drawing.

BRIEF DESCRIPTION OF THE DRAWINGS

The sole FIGURE is a block diagram of an emergency vehicle alarm system according to the present invention.

DETAILED DESCRIPTION OF THE PREFERRED EMBODIMENT

As shown in the drawing, the emergency vehicle alarm system 10 allows a user to select an emergency vehicle alert as a telematics service in a mobile vehicle 25*a*. As used herein, the term "telematics" refers broadly to the combination of computer information technologies and telecommunications, and more particularly to automobile or vehicle systems that combine global positioning system (GPS) technologies with wireless telecommunication services and other wireless computer network services to provide various forms of assistance and information to the driver or occupants of the vehicle.

The telematics unit 25*b* is equipped to receive a signal from GPS satellite 20 to aid in determining the precise location of vehicle 25*a*. The telematics unit 25*b* of vehicle 25*a* communicates with a telematics operations center 60 via the Internet 102 and a mobile switching center (MSC) 50. In the system 10, the telematics unit 25*b* provides a user-selectable emergency vehicle alert service. When the user selects the emergency vehicle alert service from telematics unit 25*b*, the telematics unit 25*b* transmits the selection to the mobile switching center (MSC) 50, which communicates the selection information to telematics operations center 60 via the Internet 102. The telematics operations center 60 determines an emergency vehicle alert service fee, bills the user, and debits the user's account accordingly. Next, the telematics operations center 60 enables the emergency vehicle alert service by sending a signal to the telematics unit 25*b* via the Internet 102 and the MSC 50. Details of an exemplary telematics services provisioning method that could be used to implement portions of the system 10 are disclosed in U.S. Pat. No. 7,406,321, issued on Jul. 29, 2008, which is hereby incorporated by reference in its entirety.

The emergency vehicle 15*a* receives a GPS signal from the satellite 20 in order to determine precisely the location of emergency vehicle 15*a*. Additionally, the emergency vehicle 15*a* is equipped with a universal transmitter 15*b* that transmits a limited range signal adapted for reception by a receiving module of telematics unit 25*b*, or by any other commercially available telematics unit. Preferably, the receiver in the system will have the capability to accommodate reception and interpretation of signals from any frequency transmitted by an emergency vehicle. When the emergency vehicle signal is received by the receiving module of an enabled telematics unit 25*b*, an audio and/or visual alert is generated to alert the occupants of civilian vehicle 25*a* that emergency vehicle 15*a* is nearby. Moreover, the receiving module of enabled telematics unit 25*b* silences whatever program is playing on the sound system of vehicle 25*a* so that the driver's attention is drawn solely to the audio/visual emergency alarm generated by activation of the receiving module.

An exemplary audio alarm generated by the receiving module of telematics unit 25*b* is a distinctive beeping or buzzing sound clearly audible to the occupants of vehicle 25*a*. An exemplary visual alarm generated by the receiving module of telematics unit 25*b* is a flashing light clearly visible to the occupants of vehicle 25*a*. The alert signal transmitted by the universal transmitter 15*b* may also include the GPS coordinates of the emergency vehicle 15*a*. Using the GPS coordinates transmitted by transmitter 15*b* of emergency vehicle 15*a* and the GPS coordinates acquired by reception of a GPS signal from the satellite 20, the telematics unit 25*b* of the vehicle 25*a* may also determine and display relative positioning of the emergency vehicle 15*a* and the vehicle 25*a*. Details of an exemplary emergency vehicle approaching alerting system that could be used to implement portions of the system 10 are included in U.S. Patent Publication No. 20040036627, published on Feb. 26, 2004, which is hereby incorporated by reference in its entirety.

It is also within contemplation of the emergency vehicle alarm system 10 to provide for mandatory activation of the emergency vehicle alert service, and to bill and then debit the user upon initial subscription to basic services available on the telematics unit 25*b*. Additionally, the transmitter 15*b* of the system 10 could be installed on non-emergency vehicles, such as trains, buses, and other priority vehicles, to warn occupants of vehicle 25*a* of proximity to such vehicles.

It is to be understood that the present invention is not limited to the embodiment described above, but encompasses any and all embodiments within the scope of the following claims.

We claim:

1. An emergency vehicle alarm system, comprising:

means for providing an emergency vehicle alert as a telematics service deliverable to a mobile vehicle;

means for determining a service fee for the emergency vehicle alert service;

means for billing the user according to the service fee-determining step;

means for debiting the user's account according to the billing step;

means for delivering the emergency vehicle alert service to the mobile vehicle, wherein when an emergency vehicle is in proximity to the mobile vehicle, an alarm is generated by the emergency vehicle alert service so that the occupants of the mobile vehicle are warned that the emergency vehicle is nearby;

means for sending an emergency alert from a priority vehicle to the mobile vehicle when said priority vehicle is in proximity to the mobile vehicle;

means for receiving the emergency alert in the mobile vehicle;

means for actuating said alarm in the mobile vehicle based on reception of the emergency alert from the priority vehicle;

means for silencing a program playing on a sound system of the mobile vehicle so that the occupants' attention is drawn solely to the emergency alarm presented inside the mobile vehicle; and means for determining and displaying to occupants of the mobile vehicle relative positioning of the priority vehicle with respect to the mobile vehicle.

2. The emergency vehicle alarm system according to claim 1, wherein said alarm in the mobile vehicle comprises a flashing light clearly visible to the occupants of the mobile vehicle.

3. The emergency vehicle alarm system according to claim 1, wherein said alarm in the mobile vehicle comprises a distinctive sound clearly audible to the occupants of the mobile vehicle.

* * * * *